US008446427B2

(12) United States Patent
Uehori et al.

(10) Patent No.: US 8,446,427 B2
(45) Date of Patent: May 21, 2013

(54) INFORMATION DISPLAY APPARATUS, INFORMATION DISPLAYING METHOD, AND COMPUTER READABLE MEDIUM

(75) Inventors: Yukiyo Uehori, Tokyo (JP); Tohru Fuse, Tokyo (JP)

(73) Assignee: Fuji Xerox Co., Ltd., Tokyo (JP)

( * ) Notice: Subject to any disclaimer, the term of this patent is extended or adjusted under 35 U.S.C. 154(b) by 622 days.

(21) Appl. No.: 12/272,538

(22) Filed: Nov. 17, 2008

(65) Prior Publication Data

US 2009/0309892 A1 Dec. 17, 2009

(30) Foreign Application Priority Data

Jun. 11, 2008 (JP) ..... 2008-153181

(51) Int. Cl.
*G09G 5/00* (2006.01)

(52) U.S. Cl.
USPC ..... 345/619; 345/672; 345/681

(58) Field of Classification Search
USPC ..... 345/619, 672, 684, 681; 715/245
See application file for complete search history.

(56) References Cited

U.S. PATENT DOCUMENTS

| | | | | |
|---|---|---|---|---|
| 5,586,196 | A * | 12/1996 | Sussman | 382/114 |
| 7,765,471 | B2 * | 7/2010 | Walker | 715/245 |
| 2006/0129922 | A1 * | 6/2006 | Walker | 715/525 |
| 2006/0236238 | A1 * | 10/2006 | Yoshikawa | 715/530 |
| 2009/0303258 | A1 * | 12/2009 | Uehori et al. | 345/681 |

FOREIGN PATENT DOCUMENTS

| | | | |
|---|---|---|---|
| JP | 5-080726 | A | 4/1993 |
| JP | 7-146674 | A | 6/1995 |
| JP | 10-69475 | A | 3/1998 |
| JP | 11-224082 | A | 8/1999 |
| JP | 2002-366135 | A | 12/2002 |
| JP | 2003-131642 | A | 5/2003 |
| JP | 2005-322046 | A | 11/2005 |

OTHER PUBLICATIONS

Japanese Office Action for Application No. 2008-153181, dated Apr. 27, 2010.

* cited by examiner

*Primary Examiner* — Chante Harrison
(74) *Attorney, Agent, or Firm* — Sughrue Mion, PLLC

(57) ABSTRACT

An information display apparatus includes: a receiving unit that receives character sequence information arranged in a plurality of lines; an image acquisition unit that acquires a line image in which an end of an nth line and a start of an (n+1)th line of the received character sequence information are connected into a single line, n representing an integer of 1 or more; and a display unit that displays the acquired line image within a predetermined display range of a screen.

8 Claims, 8 Drawing Sheets

INFORMATION DISPLAY APPARATUS, INFORMATION DISPLAYING METHOD, AND COMPUTER READABLE MEDIUM

CROSS-REFERENCE TO RELATED APPLICATIONS

This application is based on and claims priority under 35 U.S.C. 119 from Japanese Patent Application No. 2008-153181 filed Jun. 11, 2008.

BACKGROUND

Technical Field

The present invention relates to an information display apparatus, an information displaying method, and a computer readable medium.

SUMMARY

According to an aspect of the present invention, an information display apparatus includes: a receiving unit that receives character sequence information arranged in a plurality of lines; an image acquisition unit that acquires a line image in which an end of an nth line and a start of an (n+1)th line of the received character sequence information are connected into a single line, n representing an integer of 1 or more; and a display unit that displays the acquired line image within a predetermined display range of a screen.

BRIEF DESCRIPTION OF THE DRAWINGS

Exemplary embodiment of the present invention will be described in detail based on the following figures, wherein.

DETAILED DESCRIPTION

Figure 1:
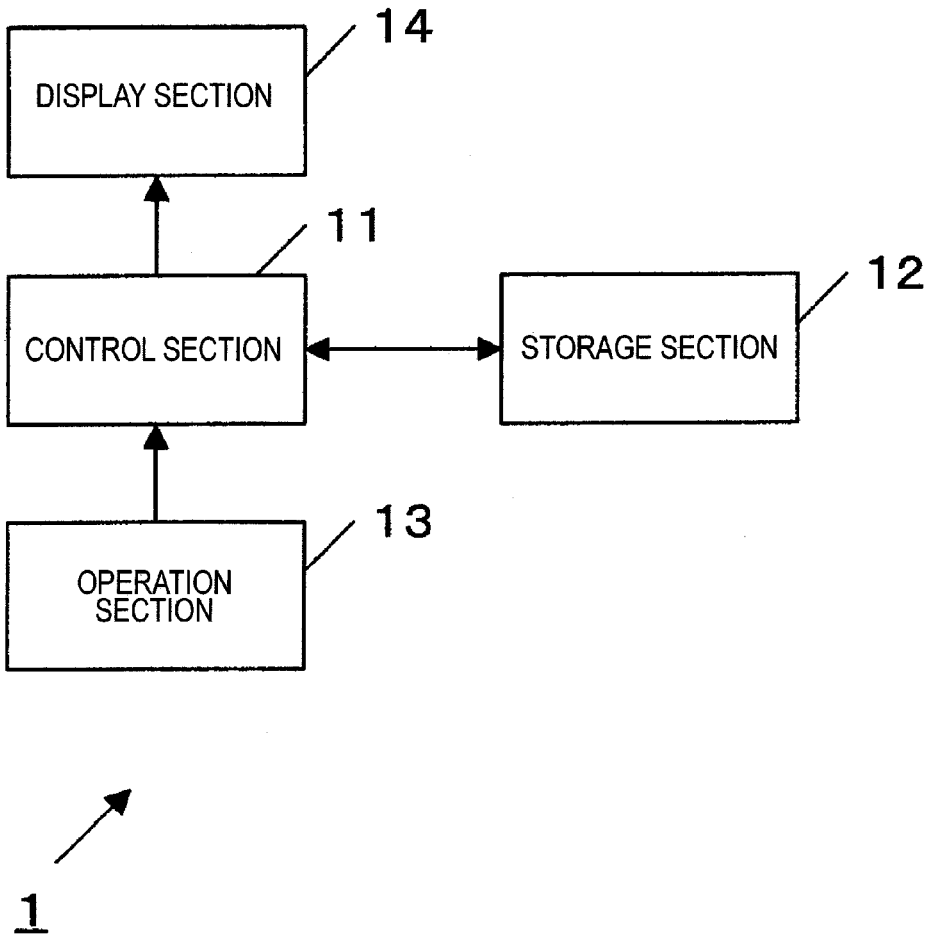
FIG. 1 is a block diagram illustrating a configuration example of an information display apparatus according to an exemplary embodiment of the present invention.

Exemplary embodiments of the present invention will be described with reference to the drawings. As illustrated in FIG. 1, an information display apparatus 1 according to an exemplary embodiment of the present invention is configured to include: a control section 11; a storage section 12; an operation section 13; and a display section 14. This information display apparatus 1 may include a communication section for transmitting/receiving character sequence information and the like via a communication unit such as a network. Further, the information display apparatus 1 may include an interface for receiving a portable memory device and the like, and may transfer character sequence information and the like, stored in the portable memory device, to the storage section 12.

The control section 11 is a program control device such as a CPU (Central Processing Unit), and is operated in accordance with a program stored in the storage section 12. This control section 11 acquires character sequence information to be subjected to a display process, and generates and acquires an image in which the end of an n-th line and the start of an (n+1)-th line of the character sequence information are connected into a single line. Then, the generated line image is displayed within a display range determined in advance in the display section 14. The detailed process contents of this control section 11 will be described later.

The storage section 12 is a storage device such as a RAM (Random Access Memory), and retains a program executed by the control section 11. This program may be stored in and provided by a CD-ROM (Compact Disc Read Only Memory), a DVD-ROM (Digital Versatile Disc Read Only Memory), and a portable memory device, for example, and may be stored in this storage section 12. This storage section 12 is also operated as a work memory of the control section 11.

The operation section 13 is constituted by, for example, a numeric keypad, and/or arrow keys or the like for providing an instruction for vertical and lateral moving directions. This operation section 13 outputs the contents of an operation, performed by a user, to the control section 11. The display section 14 is a display device such as a liquid crystal display, for example, and displays an image of a character sequence or the like at an instructed position in accordance with an instruction inputted from the control section 11.

Figure 2:
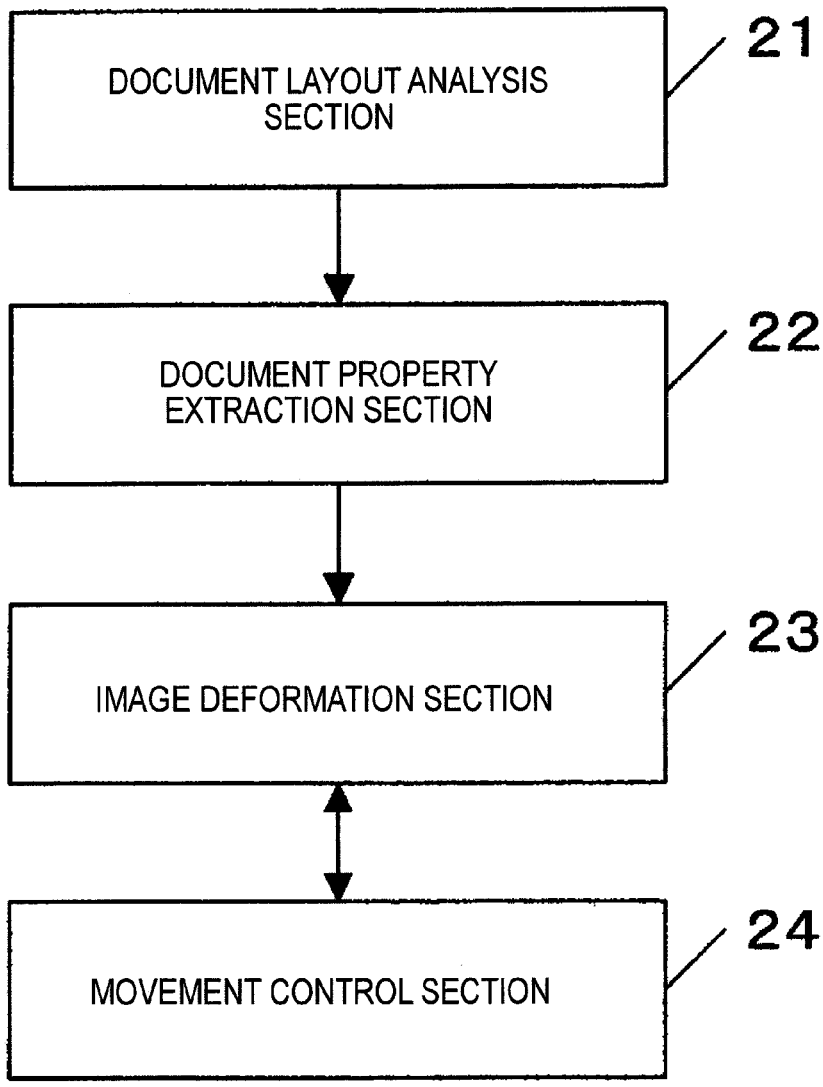
FIG. 2 is a functional block diagram of the information display apparatus according to the exemplary embodiment of the present invention.

Next, the contents of process steps performed by the control section 11 will be described. As illustrated in FIG. 2, the control section 11 of the present embodiment is functionally configured to include: a document layout analysis section 21; a document property extraction section 22; an image deformation section 23; and a movement control section 24.

Figure 3:
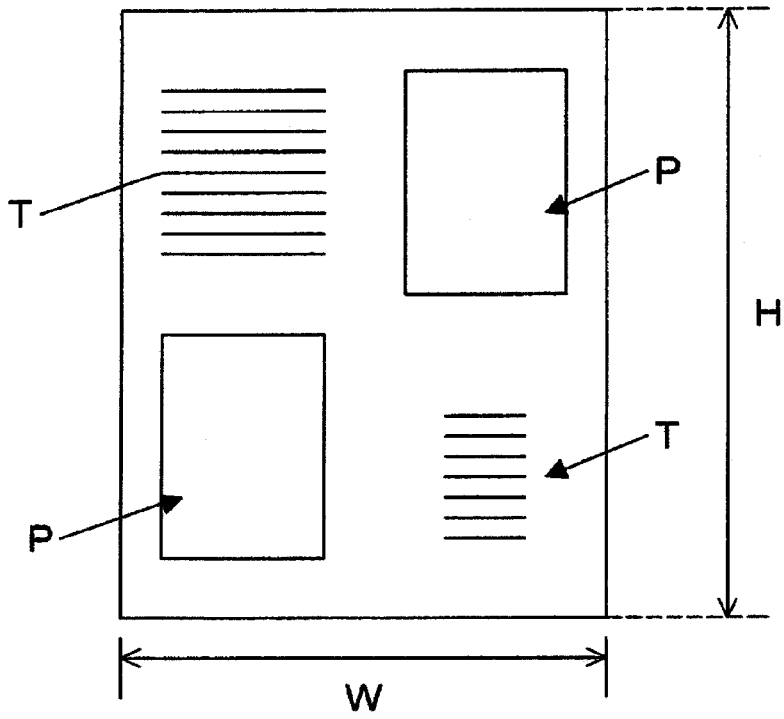
FIG. 3 is an explanatory diagram illustrating an example of a document to be processed by the information display apparatus according to the exemplary embodiment of the present invention.

The document layout analysis section 21 acquires data of a document to be processed. As illustrated in FIG. 3, for example, this document data may include, in addition to a character sequence portion (T), a pictorial portion (P) such as a diagram or a photograph. The document layout analysis section 21 identifies the character sequence portion (T) by performing a widely known layout analysis process on the acquired document data, extracts an image (original image) of the character sequence portion, and outputs the extracted image to the document property extraction section 22. It should be noted that when there are a plurality of character sequence portions, respective images of the character sequence portions are outputted while being prioritized in the predetermined order (for example, the character sequence portion located at an upper area is prioritized, and if the character sequence portions are located at the same height, the character sequence portion located leftward is prioritized). Furthermore, in the following description, the width of an original image (i.e., the character sequence length in a reading direction) is denoted by W, and the height of an original image (in a direction in which the character sequence lines are arranged) is denoted by H.

The document property extraction section 22 extracts information concerning the start position of each line, line height, line width, length between lines, and blank portion from character sequence information included in the character sequence portion image outputted from the document layout analysis section 21. For example, as illustrated in FIG. 3, the character sequence portion image outputted from the document layout analysis section 21 includes character sequence information arranged in a plurality of lines (which may be bitmap image information). The document property extraction section 22 identifies regions in which, for example, significant pixels are continuous, and groups the regions in which the distance therebetween is less than or equal to or less than a threshold value, thus identifying a block of pixels constituting each character. Then, a character circumscribing rectangle circumscribing each character is defined (FIG. 4 (S1)).

Figure 4:
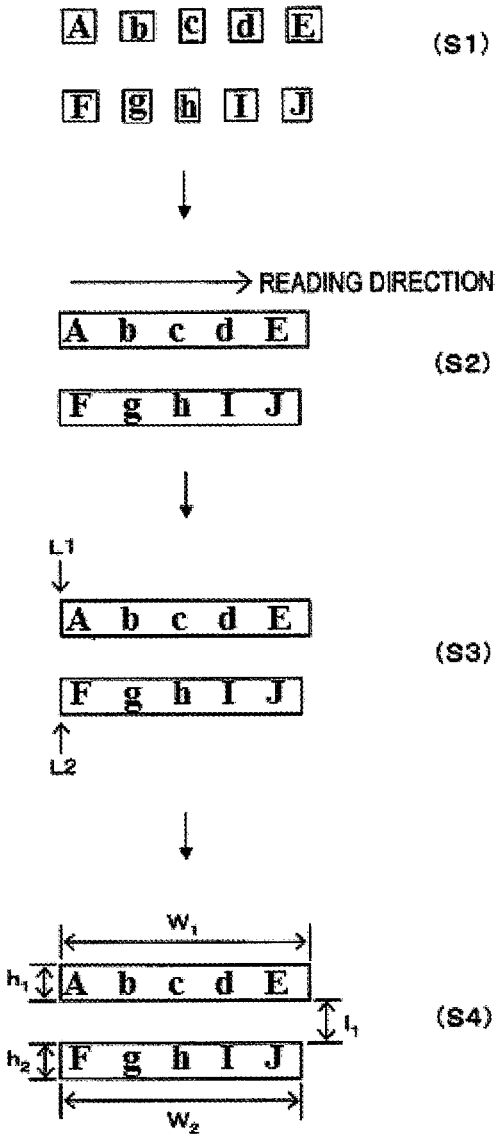
FIG. 4 shows diagrams illustrating the flow of exemplary part of process steps performed by the information display apparatus according to the exemplary embodiment of the present invention.

From the vertical average distance and lateral average distance between the adjacent character circumscribing rectangles, the document property extraction section 22 determines that the characters are read in a direction in which the distance between the adjacent character circumscribing rectangles is shorter, and obtains line circumscribing rectangles further circumscribing a plurality of the character circumscribing rectangles in the direction in which the characters are read (FIG. 4 (S2)).

Then, the document property extraction section 22 recognizes, as line start positions (L1, L2 . . . ), positions at ends of the line circumscribing rectangles, located opposite to the direction in which the characters are read (FIG. 4 (S3)).

Further, the document property extraction section 22 recognizes the height of the line circumscribing rectangle for each line (hn), the width of the line circumscribing rectangle (wn), and the distance to the adjacent line circumscribing rectangle (ln) as the line height, the line width, and the length between the lines, respectively (S4). Furthermore, the document property extraction section 22 detects a value "wmax" indicating the maximum width among the widths of the respective line circumscribing rectangles, and obtains a difference between the value "wmax" and the width of each line circumscribing rectangle as follows: Wrest_n=wmax−wn. This "Wrest_n" serves as a value representing the width of a blank portion of an n-th line. Moreover, among the respective line circumscribing rectangles, there may be obtained a value "Lmin" of the start position of the line circumscribing rectangle in which the line start position is located most opposite to the character reading direction (e.g., the most leftward line circumscribing rectangle when the characters are read from left to right), and a blank at the line starting point "|Ln−Lmin|" and a blank at the line end "Wrest_n−|Ln+Lmin|" may further be computed as blank portion information. It should be noted that in this embodiment, "|x|" represents an absolute value of "x".

The image deformation section 23 secures, in the storage section 12, a storage region for an image having at least a width of (2×W) and a height of (2×H). Further, this image deformation section 23 initially sets a variable "n", representing a noticeable line, so that n=1. Hereinafter, for simplification of the description, the following description will be made on the supposition that the character sequences are read in the direction from left to right (in the direction of an axis X). However, for example, when the character sequences are located from a higher position to a lower position, the axis may be changed, and when the character sequences are read from right to left, the axial direction may be reversed.

Figure 5:
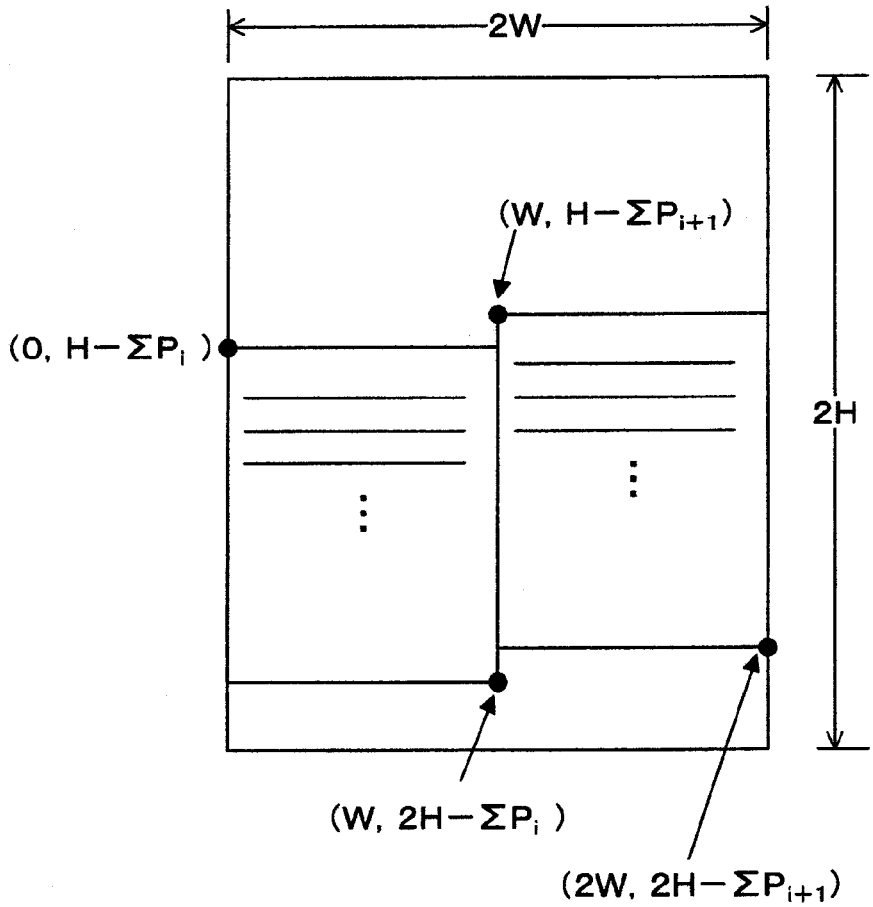
FIG. 5 is an explanatory diagram illustrating an example of a line-connected image generated by the information display apparatus according to the exemplary embodiment of the present invention.

For example, the image deformation section 23 places the original image, outputted from the document layout analysis section 21, within a range "(O, H−ΣPi−1)−(W, 2×H−ΣPi−1)" of the secured region (FIG. 5). Further, the image deformation section 23 places the same original image within a range "(W, H−ΣPi)−(2×W, 2×H−ΣPi)". It should be noted that "Pi" represents a width between a line "i" and the next line "i+1"; for example, "Pi" may be calculated as follows: Pi=hi+li, or Pi=(hi+hi+1)/2+li. In the former case, upper portions of the previous line and the next line coincide with each other, and in the latter case, center portions of the previous line and the next line (centers of the lines) coincide with each other. Furthermore, "ΣPi" represents a value obtained by performing addition on "Pi" from "i=1" to "i=n" (where "n" denotes a noticeable line).

Figure 6A:
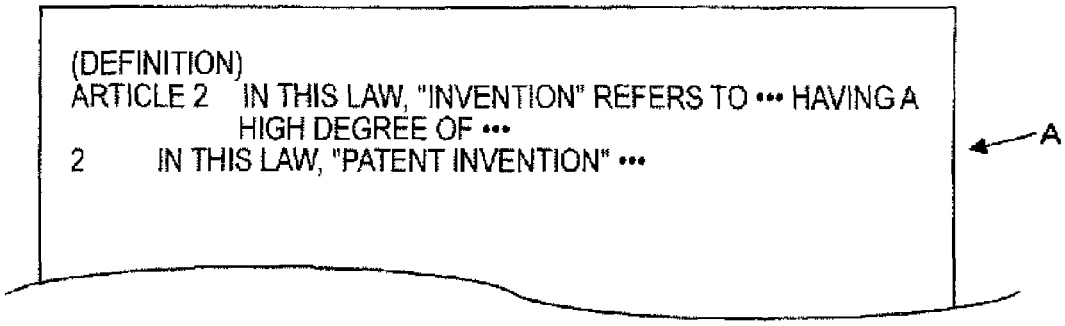
FIGS. 6A to 6C show explanatory diagrams each illustrating an example of an image generated by the information display apparatus according to the exemplary embodiment of the present invention.
Figure 6B:
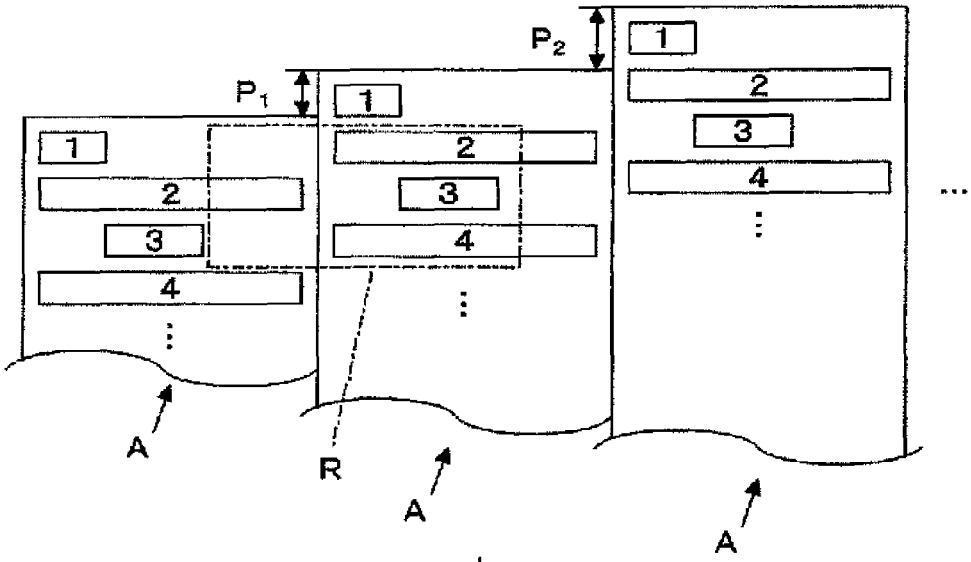
Figure 6C:
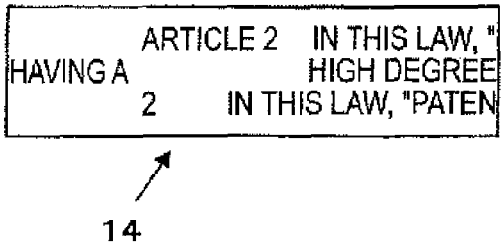

Thus, the image deformation section 23 continuously and repeatedly arranges original images in the character reading direction, and as for the images arranged adjacently, the image deformation section 23 arranges the images so that they are deviated by a line "Pn" in the direction in which the lines are arranged. Specifically, as illustrated in FIGS. 6A to 6C, the image deformation section 23 arranges a plurality of original images A so that the original images A are deviated by one line in the character sequence reading direction, thereby generating an image in which the end of the n-th line and the start of the (n+1)-th line of the character sequence information are connected into a single line. In the example shown in FIGS. 6A to 6C, an image in which the character sequences of the respective lines are aligned at a certain height (which will be called a "line-connected image") is generated in the following manner: the first line of the initial (first) original image and the second line of the next (second) original image are aligned at a certain height, and the second line of the second original image and the third line of the third original image are aligned at a certain height.

Moreover, the image deformation section 23 extracts a portion of this line-connected image, and outputs the extracted portion to the display section 14 so that the display section 14 displays the extracted portion. In other words, the image deformation section 23 receives information indicating the shape and size of a displayable range of the display section 14, and extracts, from the line-connected image, a partial image of the range equivalent to these shape and size. In one example, if the displayable range of the display section 14 is equivalent to the shape and size represented by a rectangle having the following dimensions: a width "Rw"×a height "Rh" (which will be hereinafter called an "extraction range R"), the image deformation section 23 extracts and outputs an image of this extraction range R (FIG. 6C).

The image deformation section 23 receives, from the movement control section 24, information indicating a position of this extraction range R on the line-connected image, and sets the extraction range R at a position on the line-connected image indicated by this information. Then, the image deformation section 23 extracts a partial image within the set extraction range R, and outputs the partial image to the display section 14.

Further, when the coordinate of an end side opposite to the moving direction of the extraction range R has reached the boundary of the original images repeatedly arranged, i.e., when the X-axis coordinate (where the lateral axis is defined as the X axis) of a left end side of the extraction range R has reached the width W of the original image, the image deformation section 23 moves the original image, placed within the range "(W, H−ΣPi)−(2×W, 2×H−ΣPi)", to the range "(O, H−ΣPi)'(W, 2×H−ΣPi). Furthermore, the image deformation section 23 places a new original image within the range "(W, H−ΣPi+1)−(2×W, 2×H−ΣPi+1)". Moreover, W is subtracted from the X-coordinate value of the extraction range R.

The movement control section 24 sets the position of the extraction range R on the X axis so that the first character of the first line is displayed at a predetermined position of the extraction range R (which is a center portion, for example, and which will be hereinafter called a "gaze position"). Thereafter, the movement control section 24 moves the position of the extraction range R in a certain direction on the line-connected image with the passage of time. In the present embodiment, among pieces of character sequence information arranged in a plurality of lines, the end of the n-th line and the start of the (n+1)-th line are connected to generate a one-line character sequence image; therefore, if the extraction range R is moved in one direction (X-axis direction) along this one-line character sequence image, character sequences of respective lines are sequentially scroll-displayed.

The information display apparatus 1 of the present embodiment includes the above-described configuration, and is operated as follows. The control section 11 acquires, via a communication unit such as a network, for example, data of a document to be processed. Then, a widely known layout analysis process is performed, thereby identifying a character sequence portion (T).

The control section 11 extracts information concerning the start position of each line, line height, line width, length between lines, blank portion and the like from character sequence information included in the character sequence portion image. Further, the control section 11 continuously and repeatedly arranges the extracted character sequence portion images (original images) in the character reading direction. During this time, the adjacently arranged images are located so as to be deviated by one line in the direction in which the lines are arranged, thereby aligning the end of the n-th line and the start of the (n+1)-th line with each other in a single line.

Upon generation of the image (line-connected image) in which the end of the n-th line and the start of the (n+1)-th line of the character sequence information are connected into a single line, the extraction range R, having the shape and size equivalent to the displayable range of the display section 14, is set at a position including the starting point thereof (i.e., a position corresponding to the start of the first line), and this extraction range R is moved at a certain speed (p pixels per second), for example, in the direction of the lines (i.e., the direction in which the characters are read).

The control section 11 extracts a partial image within the extraction range R from the line-connected image, and allows the display section 14 to display the extracted partial image. In accordance with the movement of the extraction range R, the line-connected image is scroll-displayed; therefore, all a user has to do is to look at a specific range of the display section 14, thus making it possible to continuously read the character sequences connected into a single line regardless of line feed of the character sequence.

Further, the extraction range R is moved at a certain speed (scroll speed) in this embodiment; however, for example, a user may be allowed to adjust the moving speed. For example, while a key of the arrow keys, which is associated with the character sequence reading direction, is pressed down, the moving speed may be increased by a predetermined speed. Furthermore, when a key associated with the direction opposite to the character sequence reading direction, the moving speed may be decreased, or the moving direction may be reversed. In the case of reversing the moving direction, the control section 11 allows the image deformation section 23 to perform the following process steps. When the coordinate of an end side opposite to the moving direction of the extraction range R has reached the boundary of the original images repeatedly arranged, i.e., when the X-axis coordinate of a right end side of the extraction range R has reached the width W of the original image, the image deformation section 23 moves the original image, placed within the range "(O, H−ΣPi)−(W, 2×H−ΣPi)", to the range "(W, H−ΣPi)−(2×W, 2×H−ΣPi), and newly places an original image within the range (O, H−ΣPi−1)−(W, 2×H−ΣPi−1)". Moreover, W is added to the X-coordinate value of the extraction range R.

Besides, the control section 11 may move the position of the extraction range R to the previous line or the next line in accordance with an instruction from a user, for example. Specifically, upon reception of an instruction for moving the extraction range R to the previous line, for example, the control section 11 moves the position of the extraction range R from the position thereof at the time when the instruction is received toward the direction opposite to the character sequence reading direction by a width of the original image. On the other hand, upon reception of an instruction for moving the extraction range R to the next line, for example, the control section 11 moves the position of the extraction range R from the position thereof at the time when the instruction is received toward the character sequence reading direction by a width of the original image.

It should be noted that when there are a plurality of pieces of character sequence information arranged in a plurality of lines (i.e., character sequence portions found out by a layout analysis process), as already mentioned above, these pieces of information are prioritized in the predetermined order, and respective images thereof are to be processed. In this case, the control section 11 may connect the end of the final line of the i-th character sequence information (character sequence portion image) and the start of the front line of the (i+1)-th character sequence information (character sequence portion image) into a single line, thus generating a line-connected image.

Further, the control section 11 may change the rendering color between a character present in a line different from a line in which there is located a range (gaze position) such as a center portion of the extraction range R where a character being read by a user should be displayed (which will be hereinafter called a "different line character), and a character that is included in a line in which the gaze position is located and that is present at least within a certain range from the gaze position (which will be hereinafter called a "gaze character"). In one example, the different line character may be displayed in light gray, and the gaze character may be displayed in dark gray or black.

Figure 7:
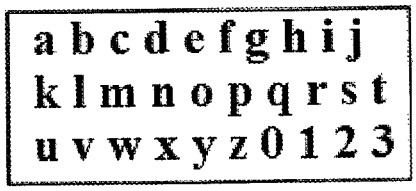
FIG. 7 is an explanatory diagram illustrating a display example of an image provided by the information display apparatus according to the exemplary embodiment of the present invention.

Furthermore, even if characters are included in a line in which the gaze position is located, the control section 11 may change the rendering color between the gaze character and the character present at a position outside a certain range from the gaze position. For example, the farther away from the gaze position, the lighter the color of the displayed characters may be (FIG. 7).

It should be noted that instead of changing the rendering color of pixels constituting characters, the rendering color of background of the gaze character may be different from that of the other portion. Further, the rendering color of pixels constituting the gaze character and that of its background may both be different from the rendering color of the other portion. Furthermore, in this embodiment, the rendering color of a character included in a line in which the gaze position is located, or the rendering color of a character present within a certain range from the gaze position is changed; however, an image other than a character included in a line in which the gaze position is located, or an image other than a character present within a certain range from the gaze position may also be displayed in rendering color different from that of the other portion. For example, an image other than a character present in a line in which the gaze position is located may be increased in chroma, and the other images may be reduced in chroma.

(Example of Diagonal Display)

Figure 8A:
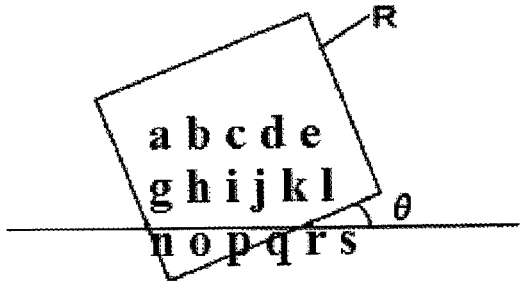
FIGS. 8A and 8B show explanatory diagrams each illustrating another display example of an image provided by the information display apparatus according to the exemplary embodiment of the present invention.
Figure 8B:
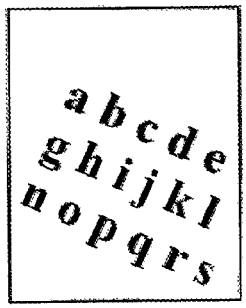

In the description made thus far, the extraction range R is a rectangle, and is set so that a pair of sides thereof is in parallel with respective associated lines included in a line-connected image, but the present invention will not be limited to this. Alternatively, in order to make it clear to a user that the next line is going to be read in the course of reading, the extraction range R is inclined by an angle θ as shown in FIG. 8A, and on the display section 14, character sequences in lines that should be gazed may be displayed so as to be aligned diagonally downward (FIG. 8B).

(Switching to Other Display Mode)

Further, the control section 11 of the information display apparatus 1 of the present embodiment may be capable of performing switching between a mode in which the line-connected image is scroll-displayed, and a mode in which the line-connected image is not scroll-displayed. In this case, in the scroll display mode, a line other than a line including the gaze position is displayed in relatively light gray, for example, as in the display shown in FIG. 7, and in the non-scroll display mode, the entire lines may be displayed as character images having a uniform density. Furthermore, in the non-scroll display mode, an underline may be displayed for a line including the gaze position, or a rectangle surrounding a line including the gaze position may be displayed.

Figure 9A:
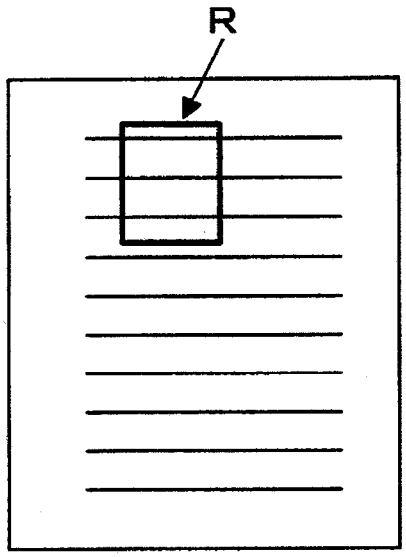
FIGS. 9A and 9B show explanatory diagrams each illustrating still another display example of an image provided by the information display apparatus according to the exemplary embodiment of the present invention.
Figure 9B:
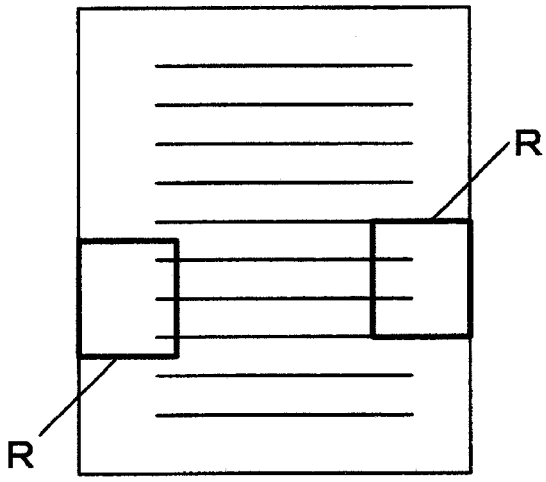

Moreover, as shown in FIG. 9, the control section 11 may perform a display (overall display) for indicating the position of the extraction range R on the original image. In this case, the overall original image is displayed on the entire display section 14, and a rectangle indicating a region displayed in the non-scroll display mode is displayed (FIG. 9A). It should be noted that if the current extraction range R is spread over lines, the rectangle is displayed in such a manner that it is separated into right and left portions (FIG. 9B).

The control section 11 may be capable of performing mutual switching among the overall display mode, non-scroll display mode, and scroll display mode.

(Case Where Character Type is Recognizable)

Further, the control section 11 uses information about the blank at the line starting point "|Ln−Lmin|" and the blank at the line end "Wrest_n−|Ln+Lmin|" for the noticeable line "n", and may increase the scroll speed (moving speed of the extraction range R) when the gaze position of the extraction range R (e.g., the center coordinate) is located somewhere between the left end of the original image and the blank at the line starting point "|Ln−Lmin|". Furthermore, the control section 11 may increase the scroll speed (moving speed of the extraction range R) when the gaze position of the extraction range R (e.g., the center coordinate) is located somewhere between the position located leftward from the right end of the original image by the blank at the line end "Wrest_n−|Ln+Lmin|" (i.e., the front end of the blank) and the right end of the original image.

Moreover, in the description made thus far, an image of a character sequence included in an original image is supposed to be a bitmap image; however, when code information for the character sequence included in the original image (information by which the character type can be determined as a Chinese character, a Japanese phonetic syllabary, or an alphabet) is also provided, the control section 11 may use this code information to change the scroll speed (moving speed of the extraction range R) depending on the type of the character present at the gaze position (e.g., center coordinate) of the extraction range R. For example, the scroll speed may be reduced when the character type is a Chinese character, may be increased when the character type is a Japanese phonetic syllabary, and may be further increased when the character type is an alphabet.

Besides, the scroll speed may be changed in accordance with the degree of difficulty in reading a Chinese character, which is determined, for example, depending on the number of strokes of the Chinese character or which level of JIS (Japan Industrial Standard) the Chinese character is at.

In addition, the scroll speed may be changed in accordance with how a character present at the gaze position (e.g., center coordinate) of the extraction range R is modified. For example, when the size of a character is large, the scroll speed may be reduced, and in the case of a bold font, the scroll speed may be reduced.

Depending on whether or not a character sequence present around the gaze position (e.g., center coordinate) of the extraction range R is a character sequence included in a predetermined dictionary, the scroll speed may be changed. For example, generally used words are included in a dictionary in advance, and when the character sequence does not coincide with any of the words, the scroll speed may be reduced.

Moreover, the scroll speed may be changed in accordance with a distance between characters of a character sequence. For example, the narrower the distance between characters, the slower the scroll speed may be.

(Example of Arranging More Original Images)

Although an example of arranging two original images in the reading direction has been described thus far, a larger number of original images may be arranged in the reading direction. In this case, the j-th original image from the left (which is defined as the original image with a noticeable line "i") is to be located at the following position: $((j-1)\times W, H-\Sigma Pi)-(j\times W, 2\times H-\Sigma Pi)$. Further, in this case, the original image that does not overlap with the extraction range R is deleted, and the position of each original image and the position of the extraction range R are moved over in the direction of the deleted original image.

(Example of Using Server)

Moreover, in the present embodiment, instead of performing the process steps of the document layout analysis section 21 in the information display apparatus 1, the process steps of the document layout analysis section 21 may be performed in an external server device or the like. In this case, the information display apparatus 1 acquires character sequence images, resulting from the process steps performed in the server device or the like and virtually arranged in a row, and performs the subsequent process steps.

Furthermore, the process steps of the document property extraction section 22 (the process steps shown in FIG. 4) may also be performed in an external server device or the like. In this case, the information display apparatus 1 acquires, from the external server device or the like, information obtained as a result of the process steps as those performed by the document property extraction section 22, and continues the subsequent process steps of the image deformation section 23.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. An information display apparatus comprising:

a receiving unit that receives an image having a first line of text and a second line of text, the second line of text following the first line of text;

an image acquisition unit that generates a deformation image, the deformation image comprising a first copy of the entire image and a second copy of the entire image that is disposed adjacent to the first copy of the image in a horizontal direction and displaced from the first copy of the image by a distance between the first line of text and the second line of text in a vertical direction, the first copy and the second copy abutting each other along vertical edges, and acquires from the deformation image a line image in which an end of the first line of text which corresponds to that portion in the first copy and a start of the second line of text which corresponds to that portion in the second copy are concatenated into a single line of text; and a display unit that displays the single line of text within a display range of a screen.

2. The information display apparatus as claimed in claim 1, wherein the display unit changes a rendering color of a character sequence between a screen center portion and a screen end portion in the single line of text.

3. The information display apparatus as claimed in claim 1, wherein the display unit displays a portion of the single line of text within the display range, and sequentially changes the portion displayed within the display range.

4. The information display apparatus as claimed in claim 3, wherein the display unit adjusts, in accordance with an instruction from a user, a speed at which the portion displayed within the display range is changed.

5. The information display apparatus as claimed in claim 1, wherein the image acquisition unit acquires the single line of text by extracting a partial image of the deformation image.

6. The information display apparatus as claimed in claim 1, wherein the first line of text is an initial line of text of the image, the second line of text is a final line of text of the image, and the image acquisition unit acquires the single line of text in which an end of the final line and a start of the initial line are concatenated into the single line of text.

7. An information displaying method comprising:

receiving an image having a first line of text and a second line of text, the second line of text following the first line of text;

generating a deformation image, the deformation image comprising a first copy of the entire image and a second copy of the entire image that is disposed adjacent to the first copy of the image in a horizontal direction and displaced from the first copy of the image by a distance between the first line of text and the second line of text in a vertical direction, the first copy and the second copy abutting each other along vertical edges;

acquiring from the deformation image a line image in which an end of the first line of text which corresponds to that portion in the first copy and a start of the second line of text which corresponds to that portion in the second copy are concatenated into a single line of text; and displaying the single line of text within a display range of a screen.

8. A computer readable medium storing a program causing a computer to execute a process for displaying character sequence information, the process comprising:

receiving an image having a first line of text and a second line of text, the second line of text following the first line of text;

generating a deformation image, the deformation image comprising a first copy of the entire image and a second copy of the entire image that is disposed adjacent to the first copy of the image in a horizontal direction and displaced from the first copy of the image by a distance between the first line of text and the second line of text in a vertical direction, the first copy and the second copy abutting each other along vertical edges;

acquiring from the deformation image a line image in which an end of the first line of text which corresponds to that portion in the first copy and a start of the second line of text which corresponds to that portion in the second copy are concatenated into a single line of text; and displaying the single line of text within a display range of a screen.

* * * * *